United States Patent [19]

Berry

[11] 4,434,960

[45] Mar. 6, 1984

[54] APERTURED DISPLAY BOARD AND HOOK

[76] Inventor: Buford E. Berry, 403 Carol Rd., Morgan City, La. 70380

[21] Appl. No.: 361,771

[22] Filed: Mar. 25, 1982

[51] Int. Cl.[3] ..... E04G 3/00

[52] U.S. Cl. ..... 248/220.4; 248/221.1

[58] Field of Search ..... 248/220.4, 220.3, 221.1, 248/221.2, 223.2; 211/57.1, 59.1

[56] References Cited

U.S. PATENT DOCUMENTS

| | | | |
|---|---|---|---|
| 3,037,733 | 6/1962 | Roman | 248/221.2 |
| 3,310,271 | 3/1967 | King | 248/221.2 |
| 3,850,396 | 11/1974 | Orlandi | 248/221.1 |

FOREIGN PATENT DOCUMENTS

| | | | |
|---|---|---|---|
| 2451086 | 4/1976 | Fed. Rep. of Germany | 248/220.3 |

*Primary Examiner*—Ramon S. Britts
*Assistant Examiner*—Sarah A. Lechok
*Attorney, Agent, or Firm*—David L. Ray

[57] ABSTRACT

A display board and a hook for use therewith which securely prevent the hook from becoming easily dislodged by shaking the board or by removing an article suspended from the hook. The display board includes a series of apertures therein, the apertures having a vertical portion and a transverse portion, with the angle therebetween being greater than 90 degrees. The board contains at least two of such apertures having transverse portions extending to the opposite sides of the vertical portions.

16 Claims, 4 Drawing Figures

APERTURED DISPLAY BOARD AND HOOK

BACKGROUND OF THE INVENTION

The present invention relates to apertured display boards and hooks for use therewith. Apertured boards are widely used for the display of the various items in retail facilities such as hardware stores. Also, apertured boards are used in the home and in businesses for the storage of tools and other articles.

One of the disadvantages of apertured display boards of the prior art is that the hooks and hardware for suspending articles therefrom easily become dislodged from the board. There have been numerous attempts to overcome the problems associated with display boards, such as the ease with which the hooks and hardware associated with the boards may become dislodged therefrom; see, for example, U.S. Pat. Nos. 3,850,396; 3,310,271; British Pat. No. 934,767; and Australian Pat. No. 271,447.

It thus can be seen that there is a need for a display board and hook for use therewith that will not easily become dislodged from the display board when an article is removed from the hook or the board is shaken or jolted.

THE INVENTION

In accordance with the present invention there is provided a display board and a hook for use therewith which securely prevents the hook from becoming easily dislodged by shaking the board or by removing an article suspended from the hook. The display board includes a series of apertures therein, the apertures having a vertical portion and a transverse portion, with the angle therebetween being greater than 90 degrees. The board contains at least two of such apertures having transverse portions extending to the opposite sides of the vertical portions.

The hook for use in association with the apertured display board includes a generally elongated hook-shaped portion having two horizontal members attached to the shank of the hook, the two horizontal members being shorter in length than the transverse portions of said apertures and being spaced apart a distance equal to the distance between the bottoms of the vertical portions of the apertures.

The display board and associated hook of the present invention can be easily attached together but will not easily become disattached upon the removal of an item from the hook or upon jolting or shaking the board. Such advantages result partly from the fact that to remove or insert the hook, the hook must be moved upwardly or downwardly a vertical distance equal to the length of said vertical portions, and rotated to the left and to the right, sequentially.

BRIEF DESCRIPTION OF THE DRAWINGS

The above and other features of this invention contributing satisfaction in use and economy of manufacture will be more fully understood from the following description of a preferred embodiment of the invention when taken in connection with the accompanying drawings where identical numerals refer to identical parts, and in which.

BRIEF DESCRIPTION OF THE PREFERRED EMBODIMENT

Figure 1:
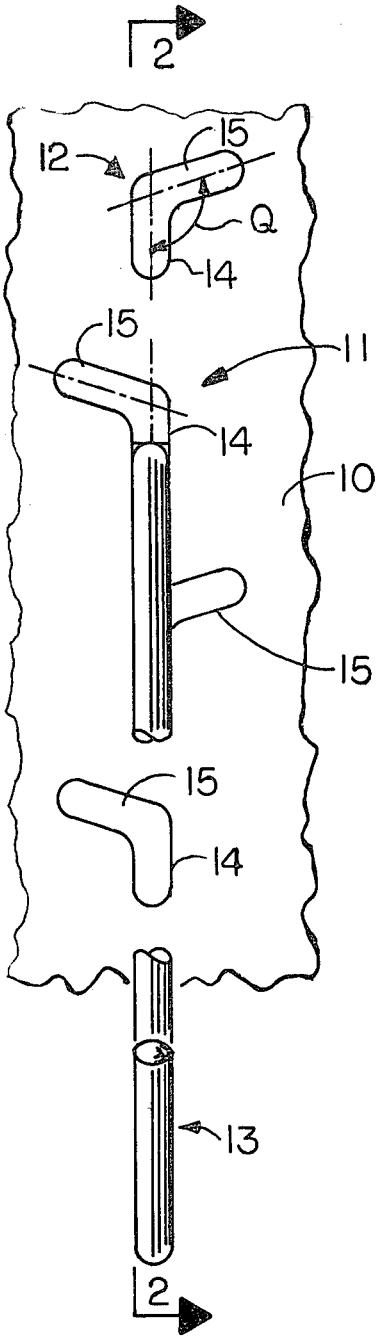
FIG. 1 is a front view of a portion of the display board of the invention having a hook connected thereto.

Referring now to the drawings, the apertured board 10 can be mounted on any suitable support surface such as a wall or display unit of any type desired. Such display units may be any of the display units well known in the art. The apertured board 10 can be formed of any suitable material such as composition board usually having a thickness of between of $\frac{1}{8}$ and $\frac{1}{4}$ inches, sheet metal and plastic and alike.

Figure 3:
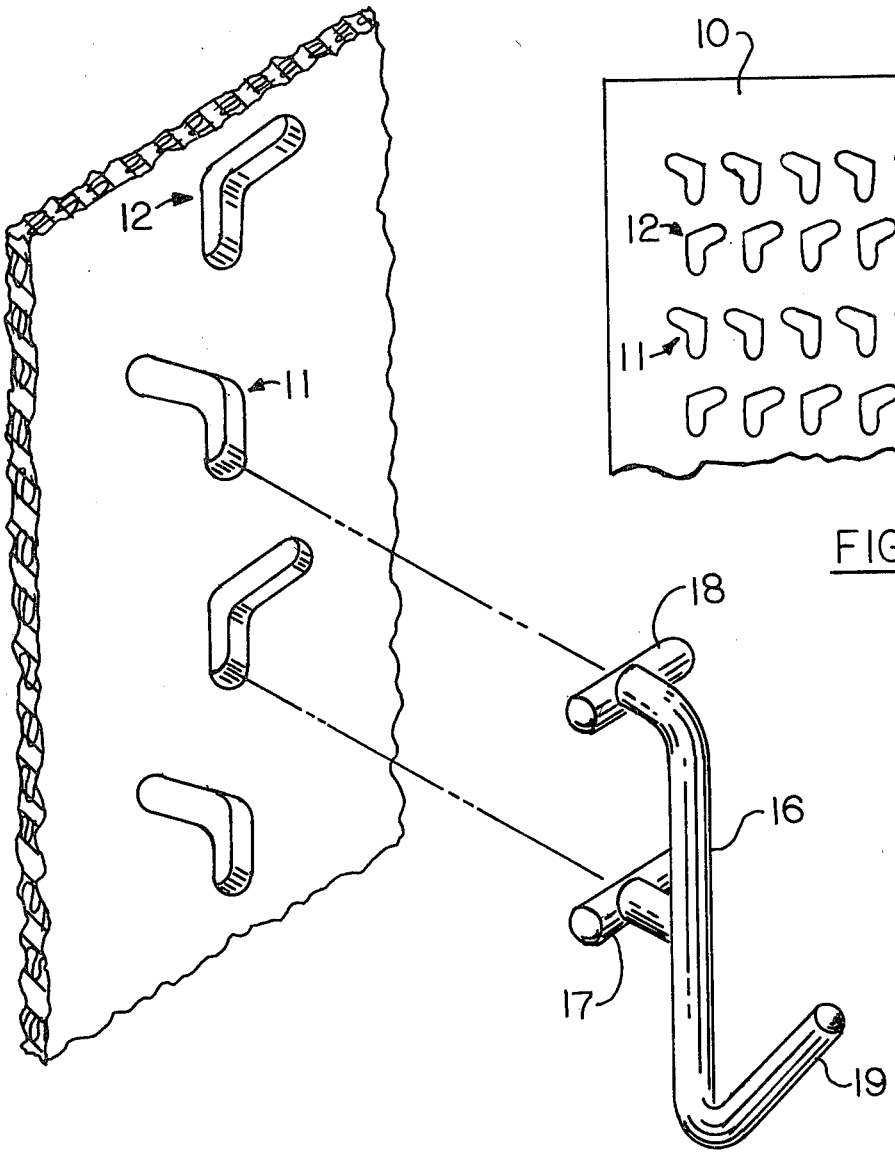
FIG. 3 is an perspective view of a fragment of the board and the hook of the invention.
Figure 4:
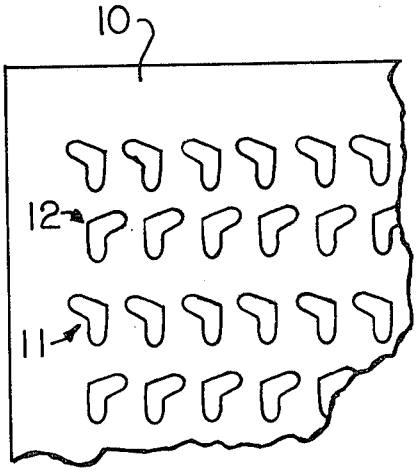
FIG. 4 is a fragmentary view of a section of the board of the invention showing a series of rows and columns of apertures.

The apertured board has a plurality of apertures arranged in vertical columns as can be seen in FIGS. 1, 3 and 4. However, in its simplest form, a board could have only two apertures generally indicated by the numerals 11 and 12 in which a single hook generally indicated by the numeral 13 could be received. The apertured board is mounted with its rear side 10*a* spaced away from the wall or other support a distance sufficient to allow clearance at the rear side of the aperture board for receiving the hooks 13 of the invention.

As can be seen in the drawings the apertures have a vertical portion 14 and a transverse portion 15 for receipt of hook 13. The transverse portion 15 is placed at an angle as shown on aperture 12 greater than 90 degrees with the vertical portion 14 so that the hook 13 may not be removed merely by sliding it upward and pulling it outwardly. To remove the hook, the hook must be turned from one side to the other.

The angle between the centerline of the vertical portion 14 and the transverse portion 15 is indicated by the letter Q. Angle Q may range from about 92 degrees to about 160 degrees. More preferably, angle Q may range from about 95 degrees to about 125 degrees.

Figure 2:
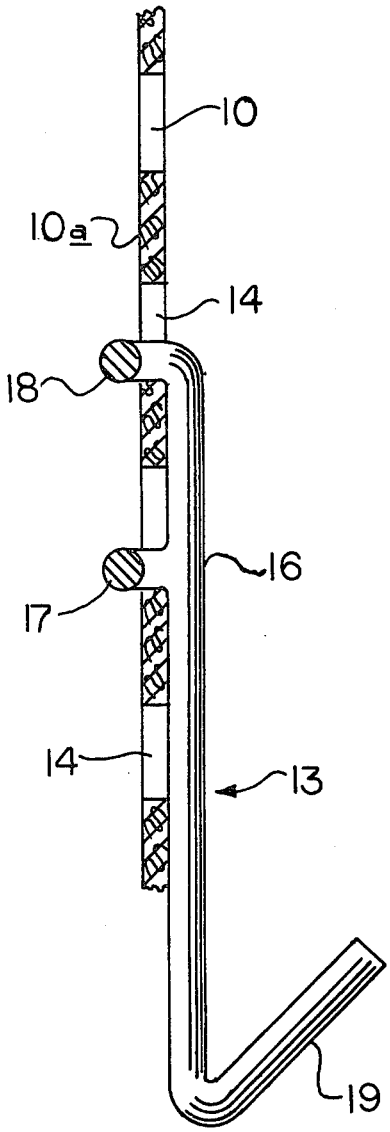
FIG. 2 is a cross-sectional view taken along lines 2—2 of FIG. 1.

Hook 13 as shown in FIGS. 2 and 3 can be seen to have a shank portion 16 which extends vertically upwardly and has two stops 17 and 18 connected thereto. The horizontal stops are spaced away from shank 16 a distance equal at least to the thickness of the apertured board 10. The stops must be slightly shorter than the length of horizontal portion 15 of the apertures. As shown in FIGS. 2 and 3, transverse stops 17 and 18 are connected to shank 16 by horizontal extensions which are equal in length to the thickness of the apertured board 10, or slightly longer.

At the lower end of shank portion 16 is leg 19. Leg 19 projects outwardly from shank 16 and may be straight as shown in FIG. 2 or may be curved similar to a fish hook. Leg 19 receives and supports articles suspended from the board.

As can be seen in FIG. 4, the preferred board of the invention has a series of rows and columns of apertures. The rows and columns of apertures are preferably spaced apart equidistantly. The apertures identified by the numerals 11 and 12 are typical of any two vertically adjacent apertures. Also, if desired more than one leg portion 19 could be attached to shank portion 16.

Although the preferred embodiments of the present invention have been disclosed and described in detail above, it should be understood that the invention is in no sense limited thereby, and its scope is to be determined by that of the following claims.

What is claimed is:

1. An article supporting apparatus comprising, in combination:

(A) a board having a plurality of apertures therein, said apertures being defined by a vertical portion and a transverse portion, said apertures being aligned in a series of rows and columns, the centerline of said vertical portions of said apertures in said rows being in alignment, said transverse portions of vertically adjacent apertures in said columns of apertures being on opposite sides of said vertical portions of said vertically adjacent apertures, and (B) a hook member comprising (a) a shank portion having a top end and a bottom end, said shank portion having stop means connected thereto, and (b) a leg portion connected to said shank portion for receipt of articles to be suspended from said board.

2. The article of claim 1 wherein the angle between said vertical portion and said transverse portion of said apertures is greater than 90 degrees.

3. The article of claim 1 wherein the angle between said vertical portion and said transverse portion of said apertures varies from about 92 degrees to about 160 degrees.

4. The article of claim 1 wherein the angle between said vertical portion and said transverse portion of said apertures varies from about 95 degrees to 125 degrees.

5. The apparatus of claim 1 wherein said stop means comprises a first and a second horizontal stop which are adapted to be received in two of said apertures.

6. The apparatus of claim 5 wherein said two horizontal stops are spaced apart on said shank portion of said hook member a distance equal to the vertical distance between the bottom of said vertical portions of two vertical aligned adjacent apertures.

7. The apparatus of claim 6 wherein said stops are spaced away from said shank portion a distance equal at least to the thickness of said board.

8. The apparatus of claim 7 wherein said stops are located on the opposite side of said shank portion from said leg portion.

9. The apparatus of claim 8 wherein said first stop is located at said top end of said shank portion.

10. The apparatus of claim 9 wherein said leg portion is located at said bottom end of said shank portion.

11. The apparatus of claim 10 wherein said second stop is located between said top and said bottom end of said shank portion.

12. An article supporting apparatus comprising, in combination:

(A) a board having a plurality of apertures therein, said apertures being defined by a vertical portion and a transverse portion, the angle between said vertical portion and said transverse portion of said apertures being greater than 90 degrees, said apertures being aligned in a series of rows and columns, said transverse portions of vertically adjacent apertures in columns of apertures being on opposite sides of said vertical portions of said vertically adjacent apertures, and (B) a hook member comprising (a) a shank portion having a top end and a bottom end, said shank portion having a first and a second horizontal stop connected thereto, said first stop being located on said top end of said shank portion and said second stop being located between said top end of said shank and said bottom end of said shank, both of said stops being parallel and located on the same side of said shank portion, both of said stops being spaced away from said shank portion a distance equal at least to the thickness of said board, both of said stops being spaced apart on said shank a distance equal to the vertical distance between the bottom of said two vertically aligned, adjacent apertures, and (b) a leg portion connected to said shank portion for receipt of articles to be suspended from said board, said leg portion being located on the opposite side of said shank portion from said stops.

13. The article of claim 1 wherein the angle between said vertical portion and said transverse portion of said apertures varies from about 92 degrees to about 160 degrees.

14. The article of claim 12 wherein the angle between said vertical portion and said transverse portion of said apertures varies from about 95 degrees to 125 degrees.

15. The apparatus of claim 12 wherein said leg portion is located at said bottom end of said shank portion.

16. The apparatus of claim 12 wherein the centerline of said vertical portions of said apertures in said rows are in alignment.

* * * * *